US011488619B2

(12) United States Patent
Waller, Jr. et al.

(10) Patent No.: US 11,488,619 B2
(45) Date of Patent: Nov. 1, 2022

(54) ADAPTIVE DYNAMIC AUDIO HUM EXTRACTOR AND EXTRACTION PROCESS

(71) Applicants: James K. Waller, Jr., Clarkston, MI (US); Jon J. Waller, Waterford, MI (US)

(72) Inventors: James K. Waller, Jr., Clarkston, MI (US); Jon J. Waller, Waterford, MI (US)

( * ) Notice: Subject to any disclaimer, the term of this patent is extended or adjusted under 35 U.S.C. 154(b) by 48 days.

(21) Appl. No.: 16/994,297

(22) Filed: Aug. 14, 2020

(65) Prior Publication Data

US 2021/0366504 A1 Nov. 25, 2021

Related U.S. Application Data

(60) Provisional application No. 62/887,243, filed on Aug. 15, 2019.

(51) Int. Cl.

| | |
|---|---|
| ***G10L 21/0232*** | (2013.01) |
| ***G10L 21/038*** | (2013.01) |
| ***G10L 25/18*** | (2013.01) |
| ***G10L 25/51*** | (2013.01) |
| ***H04R 3/04*** | (2006.01) |

(52) U.S. Cl.

CPC ..... *G10L 21/0232* (2013.01); *G10L 21/038* (2013.01); *G10L 25/18* (2013.01); *G10L 25/51* (2013.01); *H04R 3/04* (2013.01)

(58) Field of Classification Search

CPC ... G10L 21/0232; G10L 21/038; G10L 25/18; G10L 25/51; H04R 3/04

See application file for complete search history.

(56) References Cited

U.S. PATENT DOCUMENTS

| | | | | |
|---|---|---|---|---|
| 4,496,859 | A * | 1/1985 | Crooks | H03H 11/1217 330/306 |
| 5,706,354 | A * | 1/1998 | Stroehlein | H04B 15/00 381/94.1 |
| 2003/0053640 | A1 | 3/2003 | Curtis et al. | |
| 2004/0223085 | A1 | 11/2004 | Kwak | |
| 2016/0323043 | A1 | 11/2016 | Julstrom | |
| 2017/0111737 | A1 | 4/2017 | Painter et al. | |
| 2018/0076850 | A1* | 3/2018 | Zhu | H04B 3/30 |

FOREIGN PATENT DOCUMENTS

JP 2013063208 A * 4/2013

* cited by examiner

*Primary Examiner* — David L Ton
(74) *Attorney, Agent, or Firm* — GableGotwals

(57) ABSTRACT

An adaptive dynamic audio hum extractor eliminates line frequency hum components and associated higher harmonics from an audio signal. An audio signal containing line frequency hum can be processed by providing dynamically controlled notch filters at the fundamental line frequency and additional harmonic multiples of the fundamental frequency. The audio signal is detected to provide dynamic control of the depth of the notch filters. Alternatively, an audio signal containing hum can be processed by dividing the spectrum into at least two frequency bands, an unaltered high band combined with a dynamically processed low band. The adaptive dynamically controlled notch filters vary the depth of the notches in relation to the envelope or time averaged level of the bandwidth limited audio signal. This allows masking of the hum components with higher levels of audio, thereby providing transparency devoid of audio path notches.

11 Claims, 9 Drawing Sheets

ADAPTIVE DYNAMIC AUDIO HUM EXTRACTOR AND EXTRACTION PROCESS

CROSS-REFERENCE TO RELATED APPLICATIONS

This application claims the priority of U.S. Provisional Patent Application No. 62/887,243, filed Aug. 15, 2019.

BACKGROUND OF THE INVENTION

This invention relates generally to audio noise reduction and more particularly concerns reducing AC hum picked up by audio signals.

Audio hum at the AC power line frequency is commonly caused by power line hum and is a sound associated with alternating current at the frequency of the mains electricity. The fundamental frequency is at the power line frequency of 50 Hz or 60 Hz. AC electromagnetic fields are generated by AC transformers built into most equipment and appliances that connect to the AC power source. Stray AC electromagnetic fields are also generated by the high current power lines typically run within the walls or floors of most buildings. It is easily picked up by low level audio signals and is a common problem with musical instruments, especially instruments with pickups like guitars, bass guitars and pedal steel guitars. It can also be induced by poor shielding of audio cables including microphone cables and instrument cables. It has been an enemy of performing musicians, professional studio recording, broadcast sound and live sound for decades. The resulting sound, known as "hum" or "buzz," often has strong harmonic content above the fundamental 50 or 60 Hz. The spectrum of the harmonics can extend well above 1 KHz and has been impossible to remove without degradation of the audio signal.

Since 1934, instruments have long used hum-bucking pickups to alleviate this problem but many musicians choose to live with the problem because they prefer the tonal responses of single coil pickups which produce a desirable spectral balance of the instrument with more pronounced high-mid and high frequencies.

Thereafter came the adaptation of fixed-notch filters used in radio applications and also in professional recording studios. The fixed-notch filter adaptation afforded limited improvement by removing the fundamental frequency and multiple harmonics of the fundamental frequency. While this can remove hum components, it also removes portions of the spectrum of the audio signal, a less than desirable audible side effect. For example, fixed notches at the fundamental and first 3 harmonics of 60 Hz, 120 Hz, 180 Hz and 240 Hz, when used on a bass guitar, will greatly reduce the fullness and rich bass tonal quality of the instrument. Higher frequency notches will greatly change the spectral balance of guitars and other instruments with more full-spectrum frequencies.

In the late 1980s and early 1990s, the advent of digital electronics made the use of fixed-notch filters more cost-effective. A time delayed signal, phase inverted and summed with the original signal creates a comb filter response causing a series of notches in the resulting audio output signal, creating the audio effect known as "flanging." By modulating the time delayed signal, the frequency of the comb filter notches will change, producing the common "flanging" effect used in both recording and live performance.

Around 2007, a hum-attenuator became commercially available using a fixed time delay to create a series of notches at precisely the exact frequency of the hum components including all of the harmonics. While this could remove audible hum, the changes in the spectral balance of the audio output makes the effectiveness less than desirable. The audio output signal has an audible change in both the time and frequency domains due to adding the time delayed signal to the original audio signal. As a result, most musicians and sound engineers have opted to use noise gates and low level expanders, which are effective to attenuate the hum component when no audio is present. A low level downward expander can be set to attenuate the signal path when the audio signal is very low and will allow unity gain or no attenuation when the signal is loud or above a preset threshold. Low level expanders and noise gates can be very effective when the audio signal provides adequate masking of the actual hum components. For example, an electric guitar connected to a high gain distortion circuit will typically mask the audible hum components while playing but will produce even worse audible hum when the musician stops playing due to the increased gain of the distortion circuit. By setting a proper threshold to attenuate the signal just at the lower signal level where the hum becomes audible, the musician can effectively eliminate the intrusion of the hum components while playing, due to the masking effect combined with the low level attenuation of the downward expander.

A larger problem exists when the audio signal provides little or no masking of the hum components as is the case with lower gain guitar preamplifier, clean guitar preamplifier and/or bass guitar signals with little or no gain applied. Improvements have been made providing low level downward expanders with adaptive aspects making it possible to track the envelope of the audio signal. U.S. Pat. Nos. 7,532,730 and 8,842,852 disclose more recent improvements in the dynamic release response of low level downward expanders to provide the most transparent masking when transitioning between unity gain and expansion. By providing an adaptive response which tracks the envelope of the audio signal to produce a detector control signal variable between both a fast release when playing fast staccato notes and a slow smooth response with longer sustained notes, these inventions have helped provide greatly improved low level downward expander performance.

However, even with the improvements disclosed in the above mentioned patents, low level downward expanders simply cannot remove the audible hum present when the audio signal does not provide any masking of the hum components while the audio is present. In this situation using a noise gate or low level expander can actually modulate the hum, making the hum even more noticeable.

And so, while minor improvements have been made in reducing objectionable hum component noise, the long-standing need in the audio community for a system that can both eliminate this noise and provide an output signal devoid of the above discussed destructive side effects still remains.

It is therefore an object of the invention to provide an adaptive dynamic hum extractor and process which can effectively remove the audible hum associated with lower gain and clean signal levels that cannot be masked by the audio signal. It is a further object of the invention to provide an adaptive dynamic hum extractor and process that can remove the audible hum components without causing the audible degradation associated with fixed-notch filtering the fundamental frequency as well as the higher order harmonic frequencies. It is a further object of the current invention to provide an adaptive dynamic process by which the depth of the notches will increase adaptively based on the envelope of the decaying audio signal so as to dynamically increase in depth as the signal decays to the point where masking no longer occurs.

SUMMARY OF THE INVENTION

In accordance with the invention, a process for adaptively removing audio hum components from an input audio signal involves filtering the input audio signal with one or more notch filters at the fundamental hum frequency, detecting the level of the input audio signal to provide a control signal and dynamically varying the depth of each notch filters in the input audio signal in response to the control signal to provide a maximum notch depth of each notch filter when the input audio signal level is low and a minimum notch depth of each notch filter when the input audio signal level is high.

Filtering can be accomplished by delaying the input audio signal with a time delay equal to the inverse of the fundamental power line frequency, varying the level of the delayed input audio signal in relation to the control signal to produce a dynamically varying delayed signal, inverting the dynamically varied delayed signal and summing the inverted dynamically varied delayed signal with the input audio signal to produce dynamic notch filtering.

The process may further include filtering the input audio signal with one or more notch filters at one or more corresponding additional harmonic multiples that contain hum components to provide a maximum notch depth of each corresponding notch filter when the input audio signal level is low and a minimum notch depth of each corresponding notch filter when the input audio signal level is high.

In one higher performance configuration, the process for adaptively removing audio hum components from an input audio signal involves dividing the spectrum of the input audio signal into a low-band audio signal and a high-band audio signal. The low-band audio signal is filtered with one or more notch filters at the fundamental hum frequency. The level of the low-band audio signal is detected to provide a low-band control signal. The depth of each notch filter in the low-band audio signal is dynamically varied in response to the low-band control signal to provide a maximum notch depth of each notch filter when the input audio signal level is low and a minimum notch depth of the each notch filter when the input audio signal level is high. To produce the hum-extracted output signal, the high-band audio signal is combined with the dynamically varying low-band signal.

In another higher performance configuration, the process for adaptively removing audio hum components from an input audio signal involves dividing a spectrum of the input audio signal into a low-band audio signal, a band-pass audio signal and a high-band audio signal. The low-band audio signal is filtered with one or more notch filters at the fundamental hum frequency and the band-pass audio signal is filtered with one or more notch filters at an interval of the fundamental hum frequency. The level of the low-band audio signal is detected to provide a low-band control signal and the level of the band-pass audio signal is detected to provide a band-pass control signal. The depth of the notch filters in the low-band audio signal is dynamically varyied in response to the low-band control signal to provide a maximum notch depth of the notch filters when the low-band audio signal level is low and a minimum notch depth of the notch filters when the low-band audio signal level is high. The depth of the notch filters in the band-pass audio signal is dynamically varied in response to the band-pass control signal to provide a maximum notch depth of the notch filters in the band-pass audio signal when the band-pass audio signal level is low and a minimum notch depth of the notch filters in the band-pass audio signal when the band-pass audio signal level is high. To produce the hum-extracted output signal, the high-band audio signal is combined with the dynamically varying low-band signal.

In yet another higher performance configuration, the process for adaptively removing audio hum components from an input audio signal involves altering the input audio signal to provide a processed audio signal and dividing the spectrum of the input audio signal into a band-pass audio signal and a low-band audio signal. The level of the low-band audio signal is detected to provide a low-band control signal and the level of the band-pass audio signal is detected to provide a band-pass control signal. The spectrum of the processed audio signal is divided into low-band, band-pass and high-pass audio signal paths. The output of the processed low-band audio signal path is filtered with one or more notch filters at the fundamental line frequency. The depth of the notch filters in the low-band audio signal path is dynamically varied in response to the low-band control signal to provide a maximum notch depth of the notch filters in the low-band audio signal when the low-band audio signal level is low and a minimum notch depth of the notch filters in the low-band audio signal when the low-band audio signal level is high. The output of the processed band-pass audio signal path is filtered with one or more other notch filters at an interval of the fundamental line frequency. The depth of the other notch filters in the band-pass audio signal is dynamically varied in response to the band-pass control signal to provide a maximum notch depth of the other notch filters in the band-pass audio signal path when the band-pass audio signal level is low and a minimum notch depth of the other notch filters in the band-pass audio signal path when the band-pass audio signal level is high. To produce the hum-extracted output signal, the high-band audio signal is combined with the dynamically varying low-band signal.

For optimal performance, the process for adaptively removing audio hum components from an input audio signal involves filtering the input audio signal with multiple independent notch filters at the fundamental hum frequency and each additional harmonic frequency at which hum components are audible and dividing the input audio signal into multiple frequency bands with a center of each frequency band being at the fundamental hum frequency or a harmonic frequency of the fundamental hum frequency at which hum components are audible. The level of each of the multiple frequency bands at which hum components are audible is detected to provide corresponding multiple control signals. The depth of each independent notch filter in the input audio signal is dynamically varied in response to the control signal corresponding to the same frequency as the notch filter to provide a maximum notch depth of each notch filter when the input audio signal level in each corresponding frequency band is low and a minimum notch depth of each notch filter when the input audio signal level is high.

BRIEF DESCRIPTION OF THE DRAWINGS

Other objects and advantages of the invention will become apparent upon reading the following detailed description and upon reference to the drawings in which.

While the invention will be described in connection with preferred configurations thereof, it will be understood that it is not intended to limit the invention to those configurations or to the details of the construction or arrangement of parts illustrated in the accompanying drawings.

DETAILED DESCRIPTION

In the following detailed description similar element numbers designate corresponding structural parts or functional blocks and similar alpha symbols designate corresponding signals.

Figure 1:
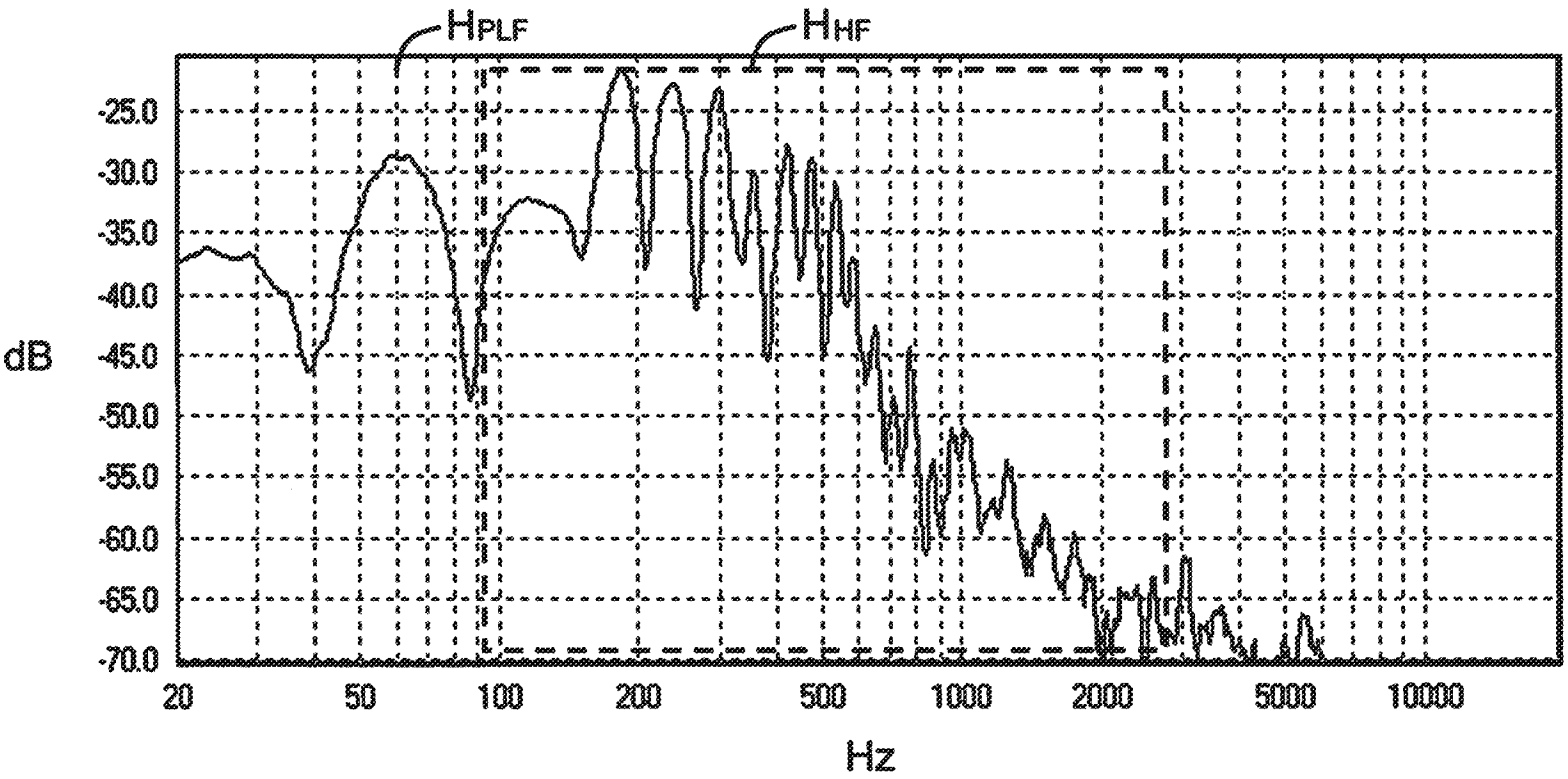
FIG. 1 is a plot of the typical spectral energy distribution of AC hum at the output of a guitar.

The plot of FIG. 1 is representative of a typical noise intrusion due to AC line frequency hum induced in an audio signal. Cancellation of the hum at the fundamental power line frequency $H_{PLF}$ and all higher order harmonics $H_{HF}$ up to at least 2 KHz is critical if all of the audible aspects of typical hum are to be eliminated.

As shown, the output spectrum of a guitar picks up typical 60 Hz hum and higher order harmonics, producing very undesirable audible hum at the fundamental power line frequency of 60 Hz. If the instrument was not picking up the 60 Hz power line frequency and associated harmonics, the actual noise floor would be greater than −60 db.

The fundamental power line frequency of 60 Hz and each harmonic component occurring at each increasing 60 Hz interval is present. The highest amplitude component is at 180 Hz. Each harmonic above 180 Hz decreases in amplitude. Simply reducing the fundamental line frequency hum component at 60 Hz would have little impact on the audible hum output of the signal because the 180 Hz, 240 Hz and 300 Hz harmonics are the highest amplitude components. The measured hum components and the balance of the harmonics in relation to the fundamental frequency will change with different environments. The requirement to remove the hum components remains the same even though the amplitude relationship of the fundamental power line frequency and harmonic components will change.

Figure 2:
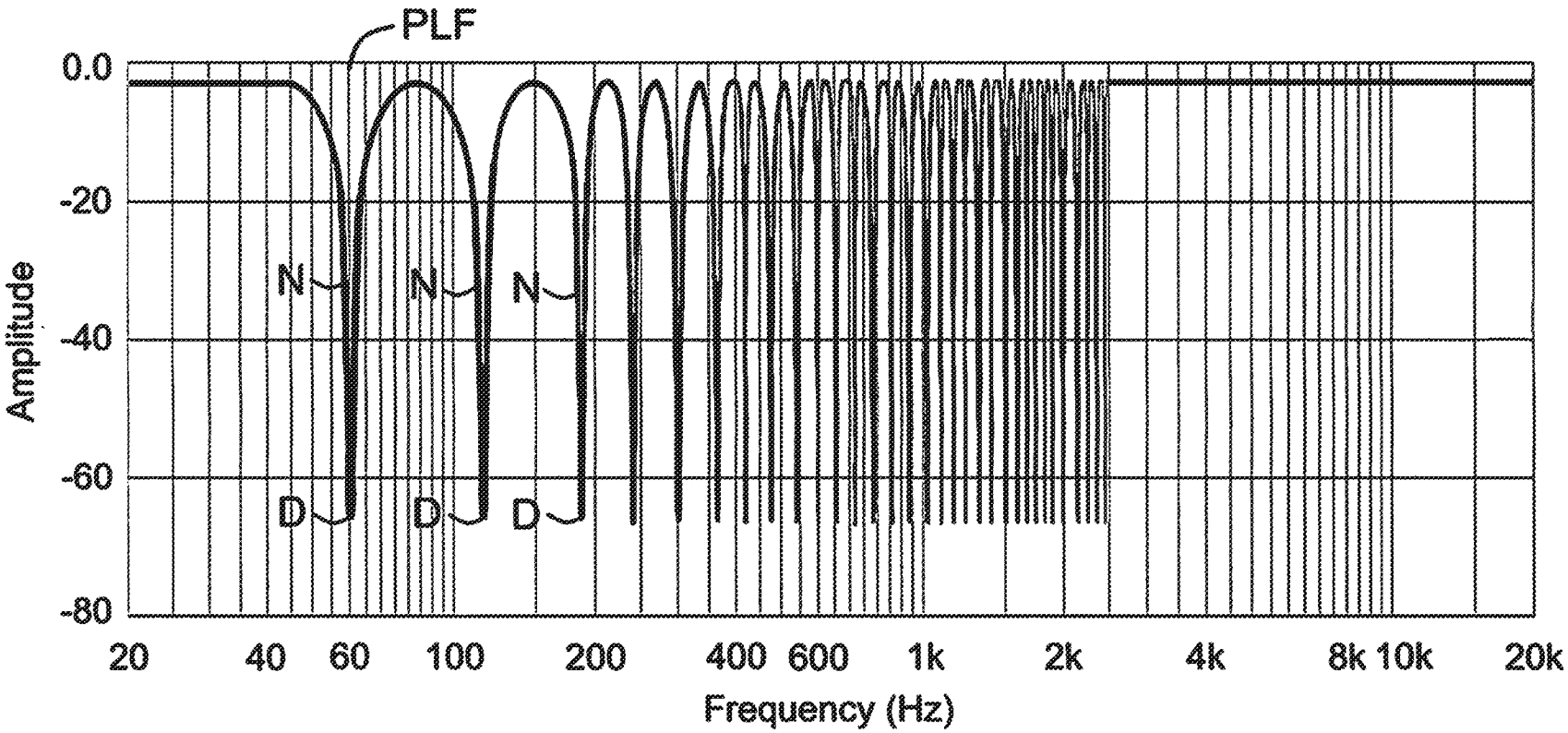
FIG. 2 is a plot of the notch filters required to completely cancel the hum of FIG. 1 from the audio signal.

Turning to FIG. 2, the plot shows the notch filters required to completely eliminate the hum components seen in FIG. 1. The notch filters are placed at the fundamental power line frequency of 60 Hz and each increasing harmonic frequency at every 60 Hz interval up to approximately 2.4 KHz. If the audio signal containing the hum shown in FIG. 1 is fed through the notch filters shown in FIG. 2, complete removal of the audible hum will result. However, it is known that processing an audio signal with notches N in the frequency response will result in audible comb filtering and produce a less than desirable output. A relatively simple way to create the required notches N is to combine the original audio signal with a time delayed and inverted signal where the delay time required is a function of T=1/fh, where T is the required delay time and fh is the fundamental power line frequency. This will produce all of the required notches N across the entire audio spectrum with the notches appearing at 60 Hz and each increasing 60 Hz interval.

This method of producing the required notches N at the required frequencies works well for its purpose, but does introduce a negative side effect. The subtle delay plus the additive aspect at the frequencies where no notch occurs adds to the undesirable sonic performance of a static system. The audible spectral change due to the notches combined with the additive delay become destructive to the original audio signal. The end result, therefore, is a final output signal that is perhaps more undesirable than was the original signal with the audible hum components.

It is also possible to generate fixed notches at each required frequency with individual, high-Q notch filters. The sonic performance may increase with the fixed-notch high-Q filter approach, but at a very sizable increase in complexity and required processing power when implemented as a digital signal processing (DSP) algorithm. By bandwidth limiting the high frequency notches N to only that shown in FIG. 2, the spectral changes in the final output will be improved and, by making the notches N dynamic in operation, a major improvement in transparency is realized. By applying the principals of masking, an additional major improvement can be realized. Making the notches N adaptively dynamic provides a final output in which the quality of the original signal is preserved. By dynamically varying the depth D of the notches N as the signal amplitude decays, effectively transparent results are achieved for moderate amounts of hum.

Adaptive Dynamic Single Frequency Band Hum Extractor

Figure 3:
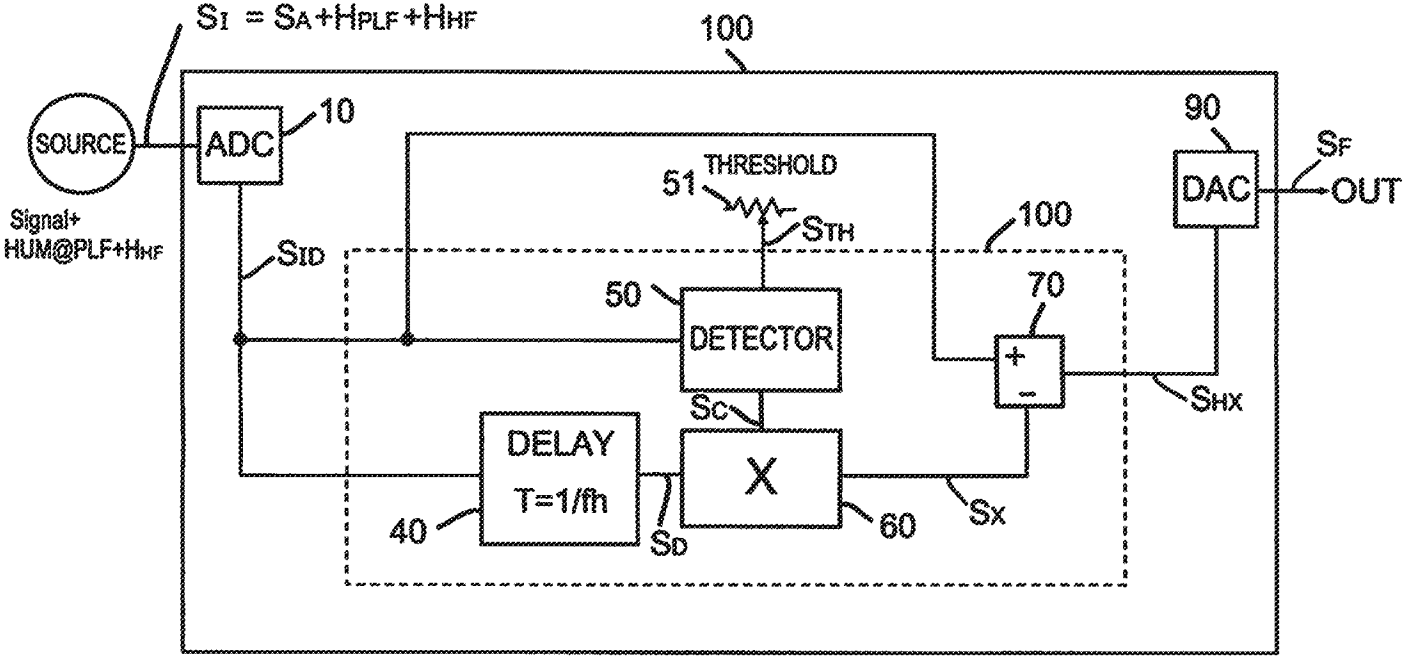
FIG. 3 is a simplified block diagram of an adaptive dynamic single frequency band hum extractor.
Figure 4:
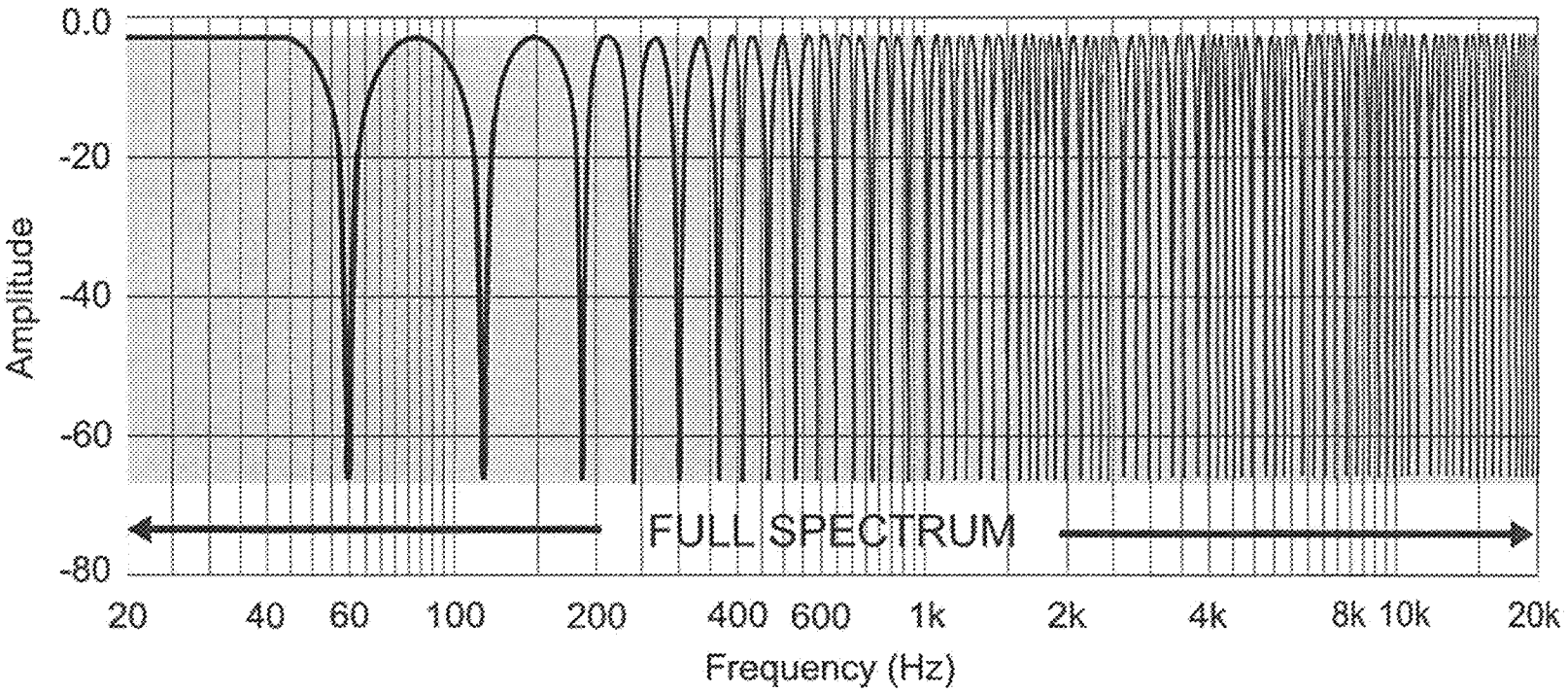
FIG. 4 is a plot of the notch filters of the extractor of FIG. 3 required to completely cancel the hum of FIG. 1 from the audio signal.

Moving on to FIGS. 3 and 4, the configuration and operation of an adaptive dynamic full spectrum single frequency band hum extractor 100 will be understood. The hum extractor 100 can be implemented by either an analog or digital design and is herein described as implemented by a DSP algorithm.

As seen in FIG. 3, an audio source input signal $S_I$ includes the audio signal $S_A$ with the hum components $H_{PLF}$ at the power line frequency PLF plus the associated higher frequency harmonic components $H_{HF}$. The input signal $S_I$ is applied to an analog-to-digital converter ADC 10 to produce a digital full spectrum audio signal Sm which is applied to the inputs of a delay 40, a detector 50 and a summer 70.

The delay 40 is set for a time delay equal to T=1/fh, where fh is the hum frequency to be removed. The output of the delay 40 is a delayed signal $S_D$ with a gain of 1 which is then fed to the input of a variable multiplier 60. In an analog embodiment of the invention, the variable multiplier 60 is a voltage controlled amplifier with a variable gain between 0 and 1. The variable multiplier 60 is dynamically controlled by the detector 50.

The detector 50 is described in detail in previously issued patents including the above-mentioned U.S. Pat. Nos. 7,532,730 and 8,842,852 and, therefore, is not now described in detail. The detector 50 receives the full spectrum signal $S_{ID}$ to produce an adaptive precision level detected output control signal $S_C$. The signal $S_C$ has a very fast release response when the audio input signal $S_I$ decays quickly and an adaptively slower response when the audio input signal $S_I$ decays slowly. The amount of ripple in the control signal $S_C$ is reduced to provide extremely low modulation of the variable multiplier 60 under the control of the detector 50 to provide the multiplier output signal $S_X$. The detector 50 also provides a threshold control signal $S_{TH}$ to a user-adjustable threshold control 51.

Looking again at both FIGS. 3 and 4, in operation the user increases the threshold control 51 until the hum $H_{PLF}$ and $H_{HF}$ is removed from the audio output signal $S_F$. As the level of the audio input signal $S_I$ increases above the user adjusted threshold setting, the depth D of the notches N decreases allowing the unfiltered signal $S_{ID}$ to pass at the output of the summer 70, thus providing transparency of the original audio signal when the notches N are removed. This allows the user to set the threshold of operation based on the actual amount of hum $H_{PLF}$+$H_{HF}$ which needs to be removed from the input audio signal $S_I$ and maintain maximum transparency in use.

When no signal with energy above the user-set threshold is present at the input to the analog-to-digital converter ADC 10, the gain of the variable multiplier 60 will be 1. Maximum notch depth D will occur in the output of the summer 70 providing notches N at the fundamental power line frequency PLF and all higher order harmonics $H_{HF}$ as multiples of the fundamental hum frequency PLF. As the input signal $S_I$ increases above threshold, the depth D of the notches N will decrease, producing a decreasing amount of attenuation at the notch frequencies. With higher level input signals $S_I$, the notches N completely disappear from the audio signal path. As the input signal $S_I$ decays, the notches N will dynamically increase based on the release response of detector 50. The notches N will adaptively change in depth D based in part on the actual envelope or time-averaged level of the audio input signal $S_I$, providing a fast response with staccato notes and a slow smooth response with longer sustained notes. With instruments like guitar and bass, this provides enhanced transparency due to the adaptive dynamic operation of the detector 50.

The output signal $S_{HX}$ of summer 70 is fed to the input of the digital-to-analog converter DAC 90 which provides the final processor output signal $S_F$. This most simplified embodiment of the hum extractor provides excellent hum extraction when no audio is present and is also useful with very moderate amounts of background hum if the audio signal $S_I$ is capable of effectively masking the hum components $H_{PLF}$+$H_{HF}$ when audio is present.

Adaptive Dynamic Split Band Hum Extractor with a Single Dynamic Band

Figure 5:
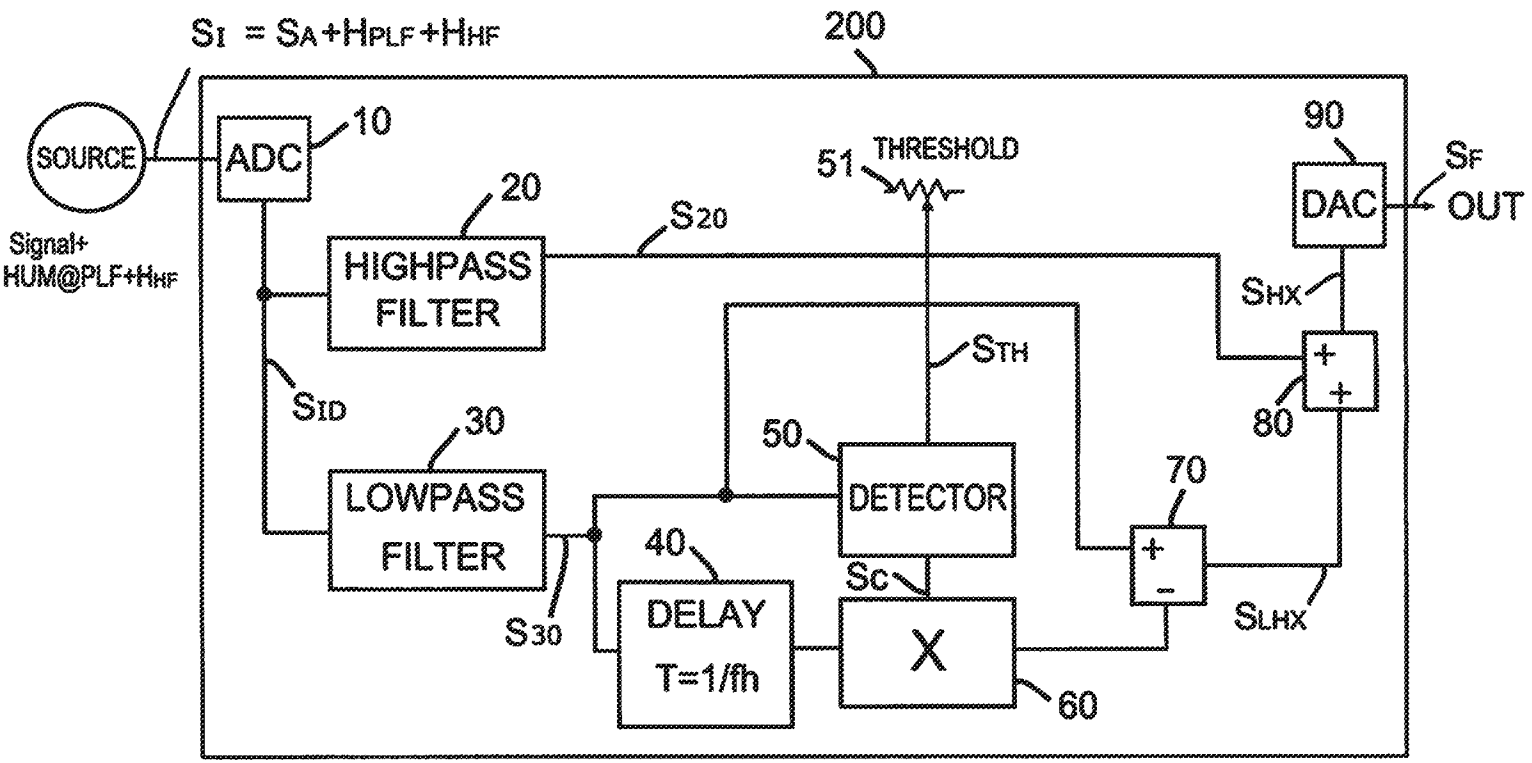
FIG. 5 is a simplified block diagram of an adaptive dynamic split band hum extractor with a single dynamic band.
Figure 6:
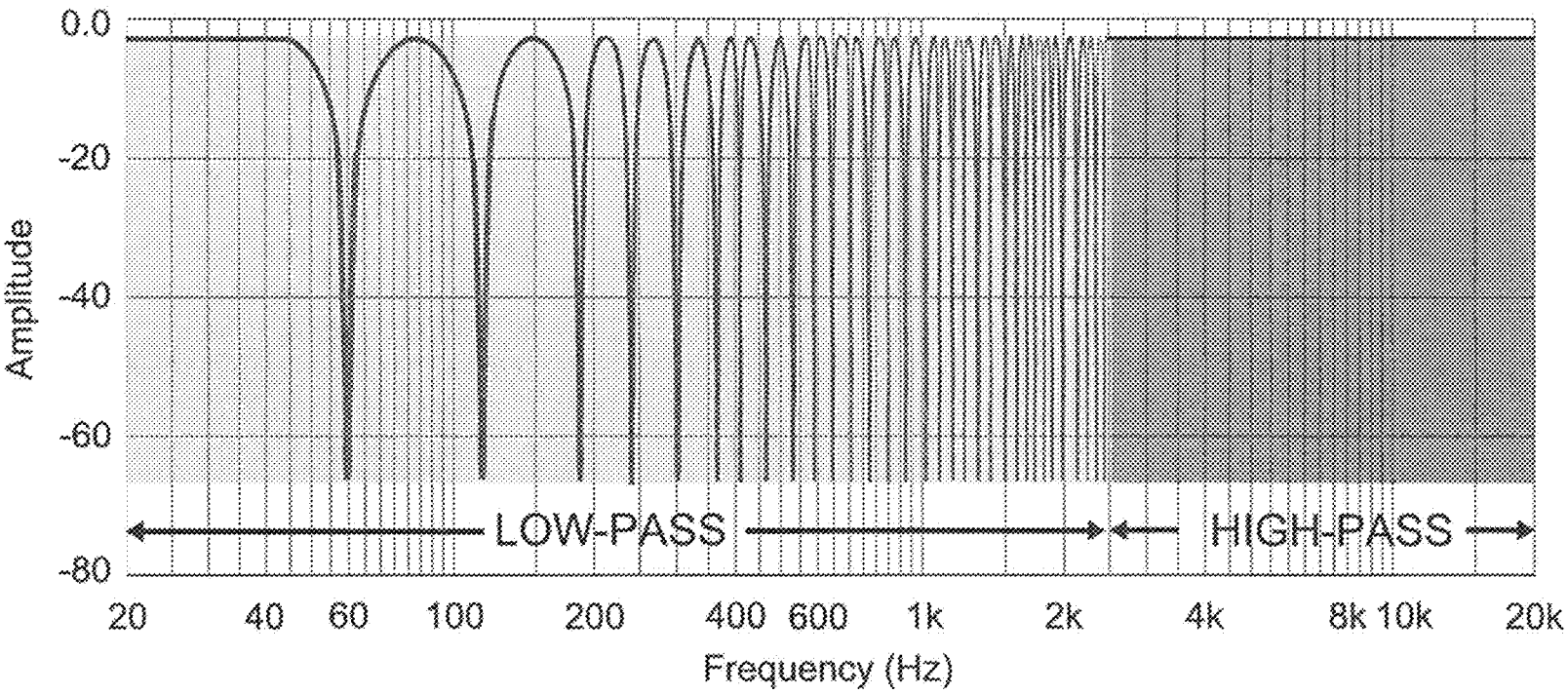
FIG. 6 is a plot of the notch filters of the extractor of FIG. 5 required to completely cancel the hum of FIG. 1 in the audio signal.

Turning now to FIGS. 5 and 6, the configuration and operation of an adaptive dynamic split band hum extractor 200 with a single dynamic band will be understood.

Looking at FIG. 5, an audio source input signal $S_I$ containing the audio signal $S_A$ plus the hum $H_{PLF}$+$H_{HF}$ at the line frequency and higher harmonics is applied to the analog-to-digital converter ADC 10. The output signal $S_{ID}$ is fed to both the high-pass filter 20 and the low pass filter 30.

The filters 20 and 30 are typically 4th order Linkwitz Riley high-pass and low-pass filters with a 24 decibel per octave response and a typical corner frequency of 2.4 KHz. The 2.4 KHz frequency is selected to provide hum cancellation up to the typical highest frequency harmonic of line hum. Other filter types can be used without major changes in the system performance but the Linkwitz Riley filter provides more accurate summation of the two frequency bands due to complementary phase shifts of the two bands in this type of filter. Higher order FIR filters with zero phase shift could be used.

The output $S_{20}$ of the high-pass filter 20 is fed directly to one positive input of a unity gain summer 80. The output signal $S_{30}$ of the low pass filter 30 is applied to the inputs of a delay 40, a detector 50 with a threshold control 51 and a summer 70 as seen and described above in relation to the adaptive dynamic single frequency band hum extractor 100 of FIG. 3. Therefore, the detector 50 provides an adaptive dynamic DC level control output signal $S_C$ which varies the gain of the multiplier 60 between 0 and 1. The detector 50 also provides the threshold control signal $S_{TH}$ to the user-adjustable threshold control 51. However, while the output $S_D$ of the delay 40 is still a delayed signal with a gain of 1, it now has the frequency response of the low-pass filter 30.

The output signal $S_{LHX}$ of the summer 70 feeds another positive input of the unity gain summer 80. The summer 80 feeds the combined adaptive dynamic low band signal $S_{LHX}$ and the unaltered high frequency band signal 52 as a composite output signal $S_{HX}$ at the input of the digital-to-analog converter DAC 90. The hum components having been removed, the output signal $S_F$ of the digital-to-analog converter DAC 90 is the final output signal of the hum extractor 200.

The single dynamic band hum extractor 200 shown in FIG. 5 provides excellent performance for moderate amounts of hum in the input signal $S_I$, a higher level of performance than possible with the adaptive dynamic single frequency band hum extractor 100 of FIGS. 3 and 4.

Multi-Band Adaptive Dynamic Hum Extractors

For higher levels of hum even more effective operation can be realized by increasing the number of dynamic bands. Considering FIGS. 7-9, the configuration and operation of multi-band adaptive dynamic hum extractors will be understood.

Figure 7:
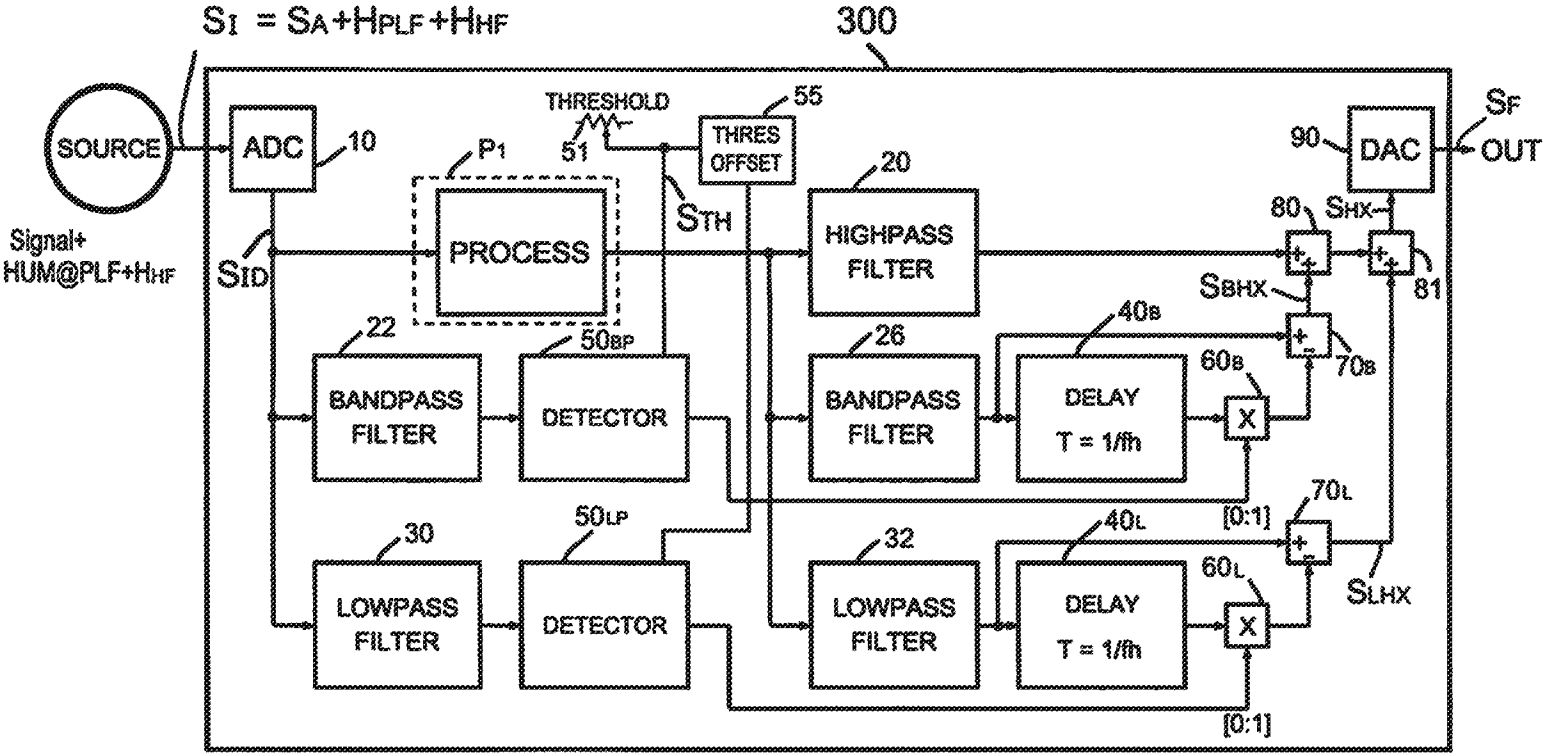
FIG. 7 is a simplified block diagram of a multiband adaptive dynamic hum extractor.

One configuration of a multi-band adaptive dynamic hum extractor 300 is seen in FIG. 7. An external source signal $S_I$ with hum at the power line frequency $H_{PLF}$+$H_{HF}$ is applied to the analog-to-digital converter ADC 10 and the output digital signal $S_{ID}$ is fed to a band-pass filter 22, a low-pass filter 30 and an internal processor $P_1$.

The internal processor $P_1$ can be any signal processing operation that alters the audio input signal $S_{ID}$ including, but not limited to, an instrument preamplifier with gain and or distortion, compression and/or equalization. Detecting the direct, unaltered input signal $S_I$ is more desirable since use of the direct input signal before other processing will provide better dynamic range and better tracking for the detectors $\mathbf{50}_{BP}$ and $\mathbf{50}_{LP}$.

The processor $P_1$ could be omitted, allowing the unaltered output signal from the analog-to-digital converter ADC 10 to directly feed the high-pass filter 20, the band-pass filter 22 and the low-pass filter 30. FIG. 7 includes the processor $P_1$ to illustrate the improved tracking advantages of detecting the direct input signal.

Continuing to look at FIG. 7, the band-pass filter 22 and the low pass filter 30 are typically designed to provide a 4th order Linkwitz Riley output response at the frequencies containing the hum in the audio spectrum. The typical high frequency corner frequency is approximately 2.4 KHz, the same as is shown in FIGS. 3 and 4, and the low frequency corner frequency between the band-pass and low-pass is typically 350 Hz. The primary low-pass filter 30 is also typically a 4th order Linkwitz Riley filter with a high frequency corner frequency of 350 Hz. The 350 Hz crossover frequency between the two dynamic bands provides excellent masking of the low frequency hum components and the higher frequency harmonics contained in typical audio hum when predominantly high frequency or predominantly low frequency signals are present in the input audio signal. The band-pass filter 22 output signal feeds detector $\mathbf{50}_{BP}$ and the output of low-pass filter 30 feed the input to detector $\mathbf{50}_{LP}$. Detectors $\mathbf{50}_{BP}$ and $\mathbf{50}_{LP}$ are the same as described with reference to FIG. 3 and are described in U.S. Pat. Nos. 7,532,730 and 8,842,852 to provide optimal performance.

Continuing with reference to FIG. 7, a user adjustable threshold control 51 is provided. Multiple threshold controls could be provided since adjustment for the sensitivity of both the band-pass operation and low-pass operation is required based on the amount of hum present. This would however increase the complexity to set proper operation by the user. It is more desirable to have a single threshold control to facilitate ease of operation by the user. Looking again at FIG. 1, the amplitude of the spectral energy of the hum components is greater at the fundamental and first few harmonic components. This requires a higher setting of the low band threshold in relation to the higher band notch filtering. Threshold offset 55 provides a 6 decibel increase in the threshold applied to low-pass detector $\mathbf{50}_{LP}$ in order to compensate for the higher energy level at the lower spectrum hum components. The offset may be different with different embodiments intended for professional audio applications, including embodiments with an even greater number of dynamic bands. However, the 6 decibel offset provides excellent operation when used for musical instruments. Optimized threshold tracking with multiband embodiments increases the transparent operation of the system.

The internal processor $P_1$ feeds the input of the filters in the audio path including a high-pass filter 20, a band-pass filter 26 and a low-pass filter 32. These filters 20, 26 and 32 are again designed with Linkwitz Riley response and 24 db per octave slopes as described above.

The output of the high pass filter 20 is un-processed and is fed directly to a positive input of the summing block 80. The output of the band-pass filter 26 is fed to the band-pass delay $\mathbf{40}_B$. The delay time of delay $\mathbf{40}_B$ is designed so that T=1/fh where fh is equal to the frequency of the hum, typically the power line frequency.

The output of the band-pass delay $\mathbf{40}_B$ feeds the input of the variable multiplier $\mathbf{60}_B$. The multiplier $\mathbf{60}_B$ is controlled by the band-pass detector $\mathbf{50}_{BP}$ and provides variable gain between 0 and 1 based on the output of the detector $\mathbf{50}_{BP}$. The output of variable multiplier $\mathbf{60}_B$ feeds an inverting input of the summing block $\mathbf{70}_B$ which then feeds the second positive input of the summing block 80.

The output of the low-pass filter 32 is fed to the input of a low-pass delay $\mathbf{40}_L$. The delay time of delay block $\mathbf{40}_L$ is also designed so that T=1/fh where fh is equal to the power line frequency of the AC line. The output of the band-pass delay block $\mathbf{40}_L$ feeds the input of the variable multiplier $\mathbf{60}_L$. The multiplier $\mathbf{60}_L$ is controlled by the band-pass detector $\mathbf{50}_L$ and provides variable gain between 0 and 1 based on the output of the detector $\mathbf{50}_B$. The output of variable multiplier $\mathbf{60}_L$ feeds an inverting input of a summing block $\mathbf{70}_L$ which then feeds a positive input of the summing block 81. The second positive input of the summing block 81 is fed from the output of the summing block 80. The output signal $S_{HX}$ of summing block 81 is a summation of all three bands with the hum components removed and feeds the input of the digital-to-analog converter DAC 90. The output of the digital-to-analog converter DAC 90 is the final audio output signal $S_F$ of the system.

In operation, the audio input source signal with hum components $S_I$ is fed to the input of the analog-to-digital converter ADC 10. The output signal $S_{ID}$ feeds the input of the process block $P_1$, the band-pass filter 22 and the low-pass filter 30. The user adjusts the threshold 51 of the system so as to eliminate any audible hum in the output signal. The audio input signal is split into three bands. The high frequency band is fed directly to the audio output since this band contains no appreciable amount of hum. The mid-frequencies are dynamically processed separately from the low frequencies to improve the subjective masking abilities of the system.

The crossover frequency between the mid-frequencies at the output of the band-pass filter 26 and low-frequencies at the output of the low-pass filter 32 allow the two dynamic bands to provide excellent masking. For example, when a high frequency note is played on an electric guitar with a fundamental frequency above the 350 Hz crossover point, the low-band detector $\mathbf{50}_{LP}$ will see very little signal level such that the low-frequency band signal path will provide excellent rejection of the low-band hum. The depth D of the low frequency notches N will remain extremely deep, since there is little or no energy detected by the detector $\mathbf{50}_L$ required to change the gain of the variable multiplier $\mathbf{60}_L$. The mid-band signal will contain adequate spectral energy due to the harmonic content of the instrument so as to mask the high frequency hum components with higher level input signals. By reducing the high-frequency notches N and allowing the masking of the high frequency hum harmonic components by the actual audio signal while also attenuating the low frequency hum components with very deep notches N in the low-frequency signal path, the resulting audio output signal retains all of the proper spectral information without alteration. As the note decays, the depth D of the high frequency notches N will dynamically increase so as to attenuate the high frequency hum harmonic components as they become audible.

The subjective results of the multi-band system are excellent and, even with high amounts of hum intrusion in the input source signal, the audible hum at the output is virtually eliminated. Conversely, if a low frequency signal well below 350 Hz is played, the low frequency signal will provide masking of the low frequency hum until the note decays to the point where the notch depth D increases. The high frequency harmonic spectral energy above the fundamental low frequency note will cause the depth of the high band notches N to decrease momentarily so as to not color the high frequency harmonic spectral balance of the high frequency components. As the high frequency energy in the input audio signal decays, the notches N will increase in depth D so as to attenuate any audible intrusion of the high frequency hum harmonic components.

With proper setting of the user adjustable threshold 51 based on the level of hum present in the input audio source signal $S_I$, the net results are excellent. The multiband dynamic configuration disclosed provides excellent attenuation of the hum components while further improving the transparency of the final output signal and avoids coloration of the audio signal due to the dynamic operation of the notches N in the multiband audio path.

Figure 8:
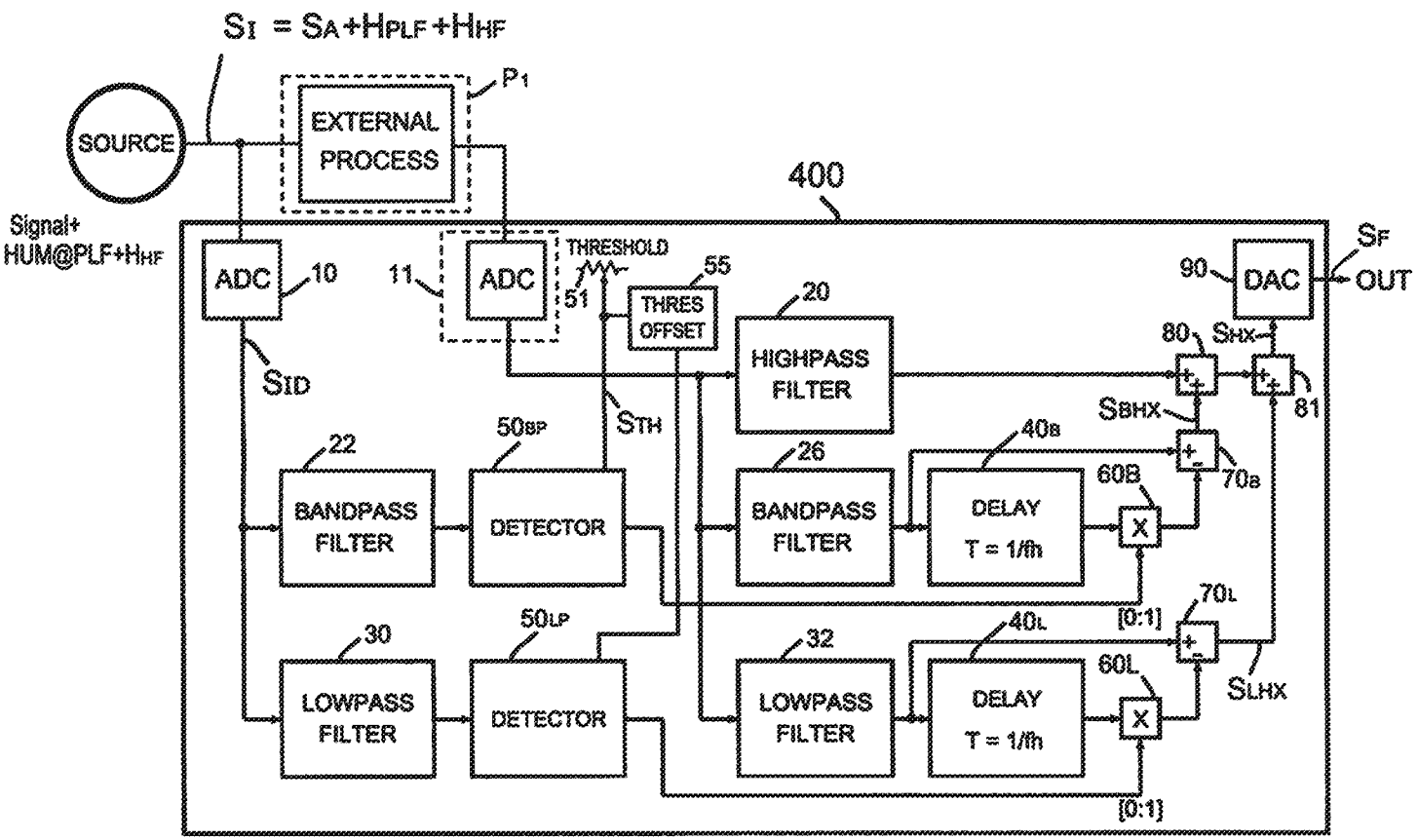
FIG. 8 is a simplified block diagram of a multiband adaptive dynamic hum extractor that can be used with an external signal processor.
Figure 9:
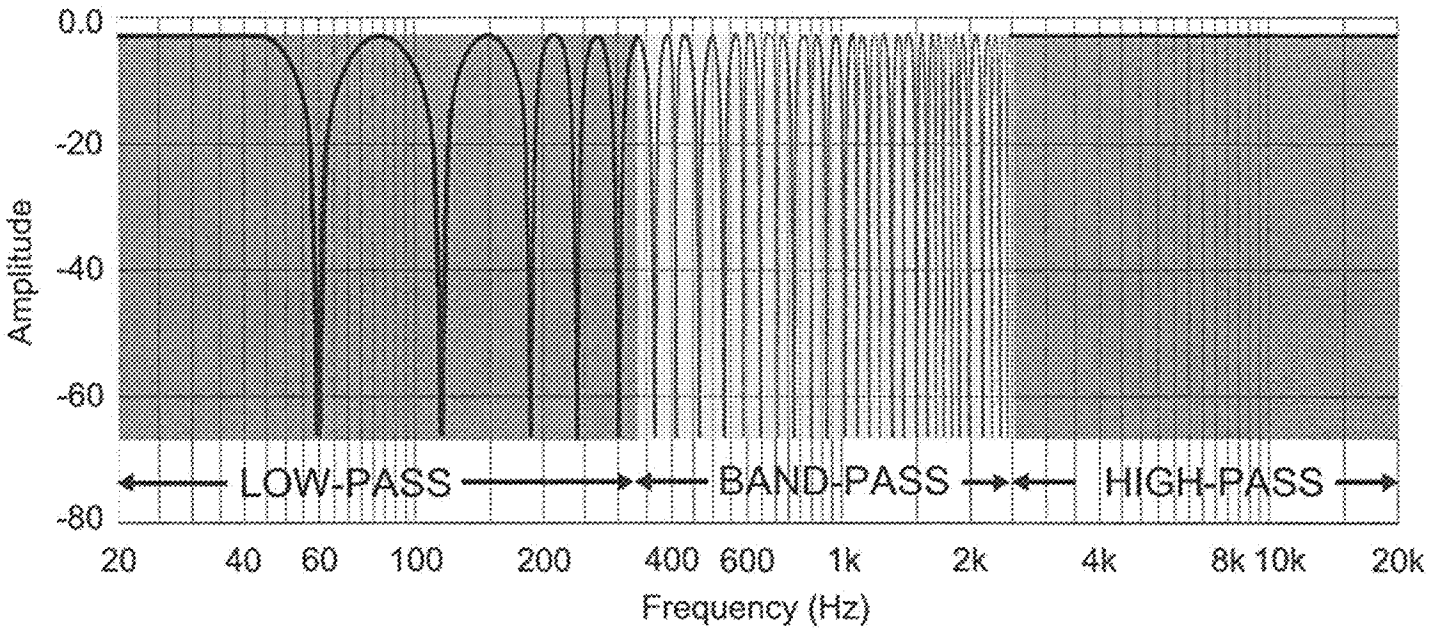
FIG. 9 is a plot of the notch filters of the extractors of FIGS. 7 and 8 required to completely cancel the hum of FIG. 1 in their respective audio signals.

Moving on to FIG. 8 an adaptive dynamic multi-band hum extractor is shown that can be used with an externally connected signal processor. FIG. 8 is identical to that of FIG. 7 but the processor $P_1$ is connected externally, allowing the user to connect any desired external signal processor for use with the invention. When the process function is internal, as in FIG. 7, the process is done completely in the digital domain after the analog-to-digital conversion, allowing the output of the processed signal to directly feed the inputs of the high-pass filter 20, the band-pass filter 26 and the low-pass filter 32.

Moving the processing to an external configuration requires the addition of another analog-to-digital convertor ADC 11 to convert the analog output signal from the external processer $P_1$ to a digital signal in order to feed the inputs of the high-pass filter 20, the band-pass filter 26 and the low-pass filter 32. With the exception of this change the operation of the embodiment of FIG. 8 is identical to that of FIG. 7.

This will provide dynamic control of the system based on the direct input signal, not on the output of the external processor $P_1$. The audio output of the external processor $P_1$ then feeds the audio processing path of the adaptive dynamic audio hum extractor processor. As described above, with reference to FIG. 7, detecting the direct, unaltered input signal is more desirable since the direct input signal, before other processing, will provide better dynamic range and better tracking for the detectors.

In any configuration of the invention including those herein disclosed, even higher performance can be realized by increasing the number of adaptive dynamic frequency bands based on the principals described herein. Higher performance configurations with a higher number of dynamic bands will provide extremely transparent operation allowing use in very professional applications such as professional recording and live broadcast. The ultimate performance can be realized by increasing the number of dynamic frequency bands to the point that each individual notch frequency becomes independently dynamic and each notch frequency is implemented with a separate detector and dynamic variable multiplier.

In any configuration of the invention including those herein disclosed, it is possible to use known methods for audio detection, however incorporation of the advantages of the inventions disclosed in U.S. Pat. Nos. 7,532,730 and 8,842,852 combined with the current invention produce a system which becomes adaptive to the actual envelope and time averaged level of the audio input signal thereby producing further enhanced performance and transparency.

In any configuration of the invention including those herein disclosed, masking effectiveness can be increased by reducing the bandwidth of each individual band. For example, with audio signals where the hum is greater in amplitude, playing a single high frequency note may allow the low frequency hum components to become audible since there are no low frequency audio components present to mask the low frequency hum.

Alternative methods are known for deriving a control signal which can be used with the current invention to produce acceptable results without departing from the scope of the current invention. However, higher performance and transparency is achieved by use of the inventions disclosed in the above-identified patents in combination with the current invention to provide increased adaptive and transparent operation.

Thus, it is apparent that there has been provided, in accordance with the invention, an adaptive dynamic hum extractor and extraction process that fully satisfies the objects, aims and advantages set forth above. While the invention has been described in conjunction with specific configurations thereof, it is evident that many alternatives, modifications and variations will be apparent to those skilled in the art in light of the foregoing description. Accordingly, it is intended to embrace all such alternatives, modifications and variations as fall to the spirit of the appended claims.

What is claimed is:

1. A process for adaptively removing audio hum components from an input audio signal comprising the steps of:

filtering the input audio signal with at least one notch filter at a fundamental hum frequency;

detecting the level of the input audio signal to provide a control signal; and dynamically varying the depth of the at least one notch filter in the input audio signal in response to the control signal to provide a maximum notch depth of the at least one notch filter when the input audio signal level is low and a minimum notch depth of the at least one notch filter when the input audio signal level is high.

2. A process according to claim 1, the step of filtering comprising the sub steps of:

delaying the input audio signal with a time delay equal to the inverse of the fundamental power line frequency;

varying the level of the delayed input audio signal in relation to the control signal to produce a dynamically varying delayed signal;

inverting the dynamically varied delayed signal; and summing the inverted dynamically varied delayed signal with the input audio signal to produce dynamic notch filtering.

3. A process according to claim 1 further comprising the step of filtering the input audio signal with at least one other notch filter at at least one corresponding additional harmonic multiple that contains hum components to provide a maximum notch depth of the at least one other notch filter when the input audio signal level is low and a minimum notch depth of the at least one other notch filter when the input audio signal level is high.

4. A process for adaptively removing audio hum components from an input audio signal comprising the steps of:

filtering the input audio signal with at least one notch filter at a fundamental hum frequency and with at least one additional harmonic multiple containing hum components;

detecting the level of the input audio signal to provide a control signal; and dynamically varying the depth of the at least one notch filter in the input audio signal in response to the control signal to provide a maximum notch depth of the at least one notch filter when the input audio signal level is low and minimum notch depth of the at least one notch filter when the input audio signal level is high.

5. A process for adaptively removing audio hum components from an input audio signal comprising the steps of:

dividing the spectrum of the input audio signal into a low-band audio signal and high-band audio signal;

filtering the low-band audio signal with at least one notch filter at a fundamental hum frequency;

detecting the level of the low-band audio signal to provide a low-band control signal; and dynamically varying the depth of the at least one notch filter in the low-band audio signal in response to the low-band control signal to provide a maximum notch depth of the at least one notch filter when the input audio signal level is low and a minimum notch depth of the at least one notch filter when the input audio signal level is high.

6. A process according to claim 5 further comprising the step of combining the high-band audio signal with the dynamically varying low-band signal to produce an output signal.

7. A process for adaptively removing audio hum components from an input audio signal comprising the steps of:

dividing a spectrum of the input audio signal into a low-band audio signal, a band-pass audio signal and a high-band audio signal;

filtering the low-band audio signal with at least one notch filter at a fundamental hum frequency;

detecting the level of the low-band audio signal to provide a low-band control signal;

dynamically varying the depth of the at least one notch filter in the low-band audio signal in response to the low-band control signal to provide a maximum notch depth of the at least one notch filter when the low-band audio signal level is low and a minimum notch depth of the at least one notch filter when the low-band audio signal level is high;

filtering the band-pass audio signal with at least one notch filter at an interval of the fundamental hum frequency;

detecting the level of the band-pass audio signal to provide a band-pass control signal;

dynamically varying the depth of the at least one notch filter in the band-pass audio signal in response to the band-pass control signal to provide a maximum notch depth of the at least one notch filter in the band-pass audio signal when the band-pass audio signal level is low and a minimum notch depth of the at least one notch filter when the band-pass audio signal level is high.

8. A process according to claim 7 further comprising the step of combining the high-band audio signal with the dynamically varying low-band signal to produce an output signal.

9. A process for adaptively removing audio hum components from an input audio signal comprising the steps of:

altering the input audio signal to provide a processed audio signal;

dividing the spectrum of the input audio signal into a band-pass audio signal and a low-band audio signal;

detecting the level of the low-band audio signal to provide a low-band control signal;

detecting the level of the band-pass audio signal to provide a band-pass control signal;

dividing the spectrum of the processed audio signal into low-band, band-pass and high-pass audio signal paths;

filtering the output of the processed low-band audio signal path with at least one notch filter at a fundamental line frequency;

dynamically varying the depth of the at least one notch filter in the low-band audio signal path in response to the low-band control signal to provide a maximum notch depth of the at least one notch filter in the low-band audio signal when the low-band audio signal level is low and a minimum notch depth of the at least one notch filter when the low-band audio signal level is high;

filtering the output of the processed band-pass audio signal path with at least one notch filter at an interval of the fundamental line frequency; and dynamically varying the depth of the at least one notch filter in the band-pass audio signal in response to the band-pass control signal to provide a maximum notch depth of the at least one notch filter in the band-pass audio signal path when the band-pass audio signal level is low and a minimum notch depth of the at least one notch filter when the band-pass audio signal level is high.

10. A process according to claim 9 further comprising the step of combining the high-band audio signal with the dynamically varying low-band signal to produce an output signal.

11. A process for adaptively removing audio hum components from an input audio signal comprising the steps of:

filtering the input audio signal with multiple independent notch filters at a fundamental hum frequency and each additional harmonic frequency at which hum components are audible;

dividing the input audio signal into multiple frequency bands, a center of each frequency band being at the fundamental hum frequency or a harmonic frequency of the fundamental hum frequency at which hum components are audible;

detecting the level of each of the multiple frequency bands at which hum components are audible to provide corresponding multiple control signals; and dynamically varying the depth of each independent notch filter in the input audio signal in response to the control signal corresponding to the same frequency as the notch filter to provide a maximum notch depth of each notch filter when the input audio signal level in each corresponding frequency band is low and a minimum notch depth of each notch filter when the input audio signal level is high.

* * * * *